US005614261A

United States Patent [19]

Richards

[11] Patent Number: 5,614,261

[45] Date of Patent: Mar. 25, 1997

[54] PREDRAWING TREATMENT SYSTEM

[75] Inventor: James F. Richards, Lyon, Mich.

[73] Assignee: Wirelube Research Company, Lyon, Mich.

[21] Appl. No.: 894,654

[22] Filed: Jun. 5, 1992

[51] Int. Cl.[6] ..... B05D 3/02

[52] U.S. Cl. ..... 427/318; 427/327; 427/367; 427/372.2; 427/376.5; 427/434.6; 427/434.7; 427/435

[58] Field of Search ..... 427/318, 327, 427/372.2, 367, 376.5, 434.6, 434.7, 435

[56] References Cited

U.S. PATENT DOCUMENTS

| | | | |
|---|---|---|---|
| 955,552 | 4/1910 | Remmen et al. | 427/318 |
| 1,647,620 | 11/1927 | Hall | 427/318 |
| 2,275,793 | 3/1942 | Murphy | 427/435 |
| 2,859,146 | 11/1958 | Prust et al. | 427/435 |
| 2,861,897 | 11/1958 | Hendrixson | 427/318 |
| 2,870,903 | 1/1959 | Leduc | 205/21 |
| 3,294,573 | 12/1966 | Michael et al. | 117/49 |
| 3,801,367 | 4/1974 | Blair et al. | 427/318 |
| 3,886,894 | 6/1975 | Brekle | 118/6 |
| 3,976,815 | 8/1976 | Brekle | 427/327 |
| 4,142,919 | 3/1979 | Maiffredy et al. | 148/12 R |
| 4,688,411 | 8/1987 | Hagita et al. | 72/42 |

OTHER PUBLICATIONS

"Mechanical Descaler With Lubricating," dated May 1992.

*Primary Examiner*—Benjamin Utech

*Attorney, Agent, or Firm*—Dickstein Shapiro Morin & Oshinsky LLP

[57] ABSTRACT

A continuously advancing workpiece (e.g., a steel rod) is treated prior to size reduction by drawing. The rod is preheated and then a liquid (such as a borax solution) is applied to the surface of the rod. The preheating of the rod provides sufficient residual heat within the rod to rapidly and evenly dry the liquid such that the rod is provided with a thick and uniform coating. Also disclosed is a system for conditioning the coating liquid.

13 Claims, 1 Drawing Sheet

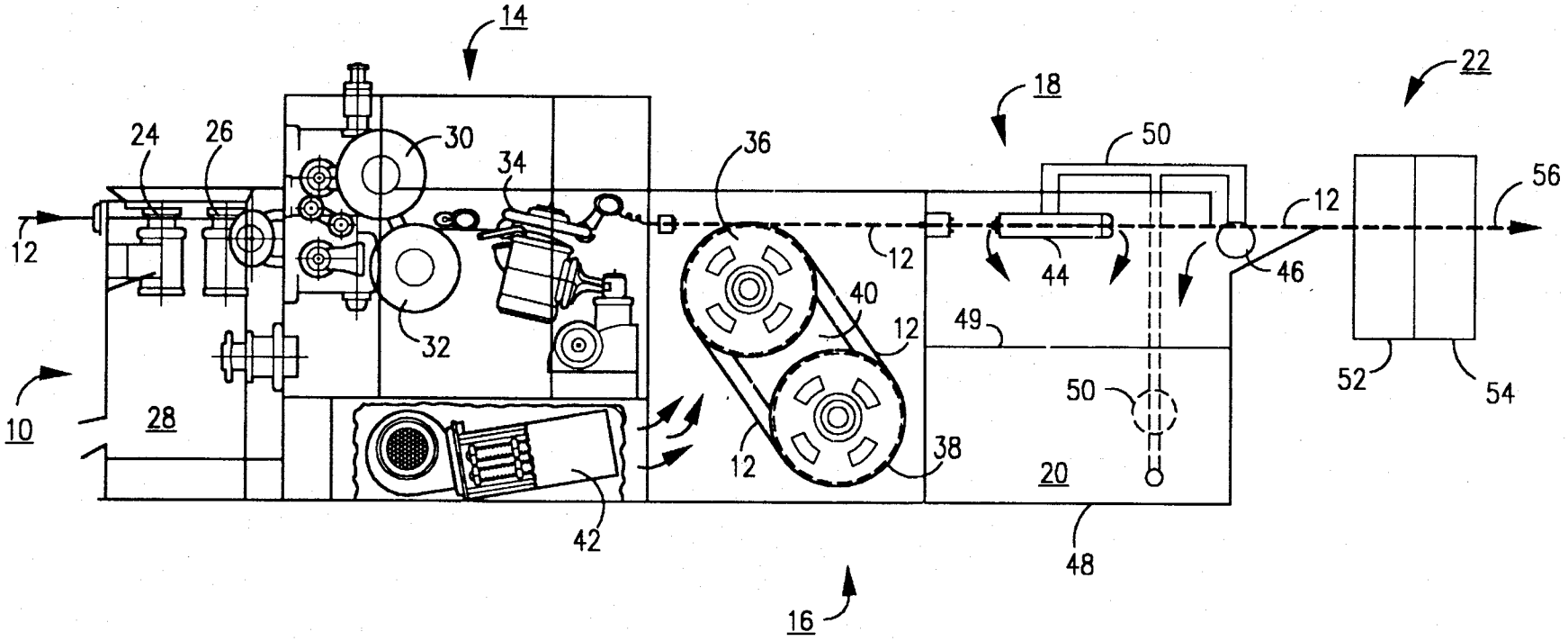
56
54
22
52
12
46
50
50
48
18
44
20
49
38
12
12
40
16
36
12
42
14
34
30
32
26
24
28
12
10

PREDRAWING TREATMENT SYSTEM

BACKGROUND OF THE INVENTION

1. Field of the Invention

The present invention relates to a system for treating a workpiece (such as a continuous steel rod) by applying a liquid to the workpiece and by heating the workpiece such that the liquid is dried by residual heat.

The present invention also relates to a system for conditioning liquid (such as a borax solution) by removing contaminants from the liquid.

2. Description of the Related Art

It is known to provide an acid pickled rod with an inorganic lubricant carrier coating prior to size reduction by drawing. The purpose of the inorganic coating is to reduce direct contact between the rod and the drawing die, and to thereby reduce die wear and metal pickup.

With the increased emphasis on pollution control, acid pickling is being replaced by a non-polluting process called mechanical descaling. Mechanical descaling is advantageous because its only by-product is brittle scale that is relatively easy to dispose of, in contrast to the voluminous spent acid that is the by-product of acid pickling.

Bare mechanically descaled steel rod cannot be drawn with the same productivity as acid pickled rod coated with an inorganic coating, even when the same lubricating system is used. Therefore, it has been suggested to provide mechanically descaled rod with an inorganic coating after descaling to simulate the traditional practice. However, attempts at treating mechanically descaled rod in this manner have not been satisfactory.

The problem is that there has been no satisfactory system for drying the mechanically descaled rod subsequent to coating liquid application. Mechanical descaling does not significantly raise the temperature of the rod being descaled. Therefore, coating liquid applied to the rod will not dry by itself. Mechanically removing a portion of the coating liquid allows the rod to dry faster, but also significantly reduces the thickness of the coating left on the rod. Drying may also be accomplished by passing the rod up to twenty times around a drying drum, through a heated tube or through a hot air dryer. But when the coating liquid is transferred to drying drums or sheaves it becomes sticky and non-uniform. The result is a thin, non-uniform coating that cannot perform with the desired effectiveness during drawing, and that cannot provide adequate protection after drawing.

SUMMARY OF THE INVENTION

The disadvantages of the prior art are alleviated to a great extent by the present invention which provides a method and apparatus for treating a rod (such as a mechanically descaled continuous steel rod) by applying a liquid (such as a borax solution, a lime suspension or an inorganic salt solution) to the surface of the rod, and by preheating the rod such that the liquid is dried by residual heat.

In another aspect of the present invention, coating liquid is conditioned by removing contaminants such as iron oxide; steel particles and rust. By removing these contaminants, the coating liquid can be dried more easily.

Other objects and advantages of the present invention will become apparent from the following detailed description and drawings which illustrate preferred embodiments of the present invention.

BRIEF DESCRIPTION OF THE DRAWINGS

The sole FIGURE is a schematic side view of a treatment system constructed in accordance with a preferred embodiment of the present invention.

DETAILED DESCRIPTION OF PREFERRED EMBODIMENTS

Referring now to the drawings, there is shown a treatment system formed of a descaling means 10 for mechanically descaling a continuous steel rod 12, a cleaning means 14 for cleaning the rod 12, a preheating means 16 for heating the rod 12, a coating means 18 for applying liquid 20 to the rod 12, and a wire drawing machine 22. An advantageous feature of the illustrated embodiment is that residual heat from the rod 12 (i.e., heat added to the rod 12 by the preheating means 16) causes the liquid 20 on the surface of the rod 12 to dry rapidly and evenly between the coating means 18 and the wire drawing machine 22.

The illustrated descaling means 10 is formed of a plurality of sheaves 24, 26. The sheaves 24, 26 are located within different planes so as to repeatedly and continuously bend the rod 12 in different directions. This causes iron oxide hot rolling mill scale and other brittle contaminants to fall from the surface of the steel rod 12 to the bottom 28 of the descaling means 10 for collection and disposal.

The function of the cleaning means 14 is to remove loose superficial rust or scale dust that remains on the surface of the rod 12 after the rod 12 has passed through the descaling means 10. The cleaning means 14 may employ wire brushes 30, 32, 34 or other suitable cleaning devices.

The function of the preheating means 16 is to heat the rod 12 upstream from the coating means 18 such that the rod 12 has the desired amount of residual heat downstream from the coating means 18 to dry the liquid 20 on the surface of the rod 12 with improved effectiveness. In the illustrated embodiment, the preheating means 16 heats the rod 12 from ambient temperature (e.g., twenty five degrees centigrade) to an increased temperature in the range of from eighty degrees centigrade to one hundred eighty degrees centigrade.

In the illustrated embodiment, the preheating means 16 includes rotatable drums 36, 38 for repeatedly transporting the rod 12 through a heated space 40, and a heater 42 for blowing hot air onto the rod 12 as the rod 12 is repeatedly transported through the space 40. However, the present invention is not limited to the use of the illustrated heater 42. The preheating means 16 may be advantageously formed of an induction heater, a conduction heater, a convection heater, an electrical resistance heater, and/or a radiation heater. Also, the present invention is not limited to the use of the rotatable drums 36, 38. For example, just one large drum may be used instead of the two drums 36, 38.

The heated rod 12 is then continuously threaded through the coating means 18. The coating means 18 applies a heavy film of the coating liquid 20 onto the surface of the rod 12. Advantageously, the coating means 18 has a plurality of coating applicators 44, 46 for applying the liquid 20 onto the rod 12. Preferably, the liquid 20 is supplied to the applicators 44, 46 from a tank 48 by a pumping system 50. Also, the tank 48 is preferably located directly underneath the applicators 44, 46. This way, excess liquid 20 drips from the applicators 44, 46 directly into the tank 48 for reuse. The surface of the liquid 20 within the tank 48 is designated by reference numeral 49.

Preferably, the coating liquid 20 is an aqueous borax solution containing five percent to forty percent by weight $Na_2B_4O_7 \cdot 5H_2O$. Preferably, the liquid 20 is applied to the rod 12 at a temperature of about ninety degrees centigrade.

In other preferred embodiments of the invention, the liquid applied to the rod 12 by the coating means 18 may be a lime suspension or an inorganic salt solution.

The preheated rod 12 exits the coating means 18 with a heavy wet aqueous film of the liquid 20. The water in this film is rapidly evaporated by the residual heat of the preheated steel rod 12. In general, there is sufficient heat to rapidly evaporate the excess water from the film on the surface of the steel rod 12 when the rod 12 has a diameter of from approximately four millimeters or larger and when the rod 12 is at a temperature of approximately eighty degrees centigrade or above. With the illustrated arrangement, the film will dry onto the rod 12 to less than about thirty percent water in about ten seconds without any wiping or additional heating. Since the film mostly dries onto the surface of the rod 12 and is not substantially removed prior to drying, substantially uniform dried coating weights of over four hundred milligrams per foot (measured by the weigh, strip, weigh method) can be consistently produced on the surface of the rod 12. Also, since the rod 12 is not, wrapped or handled until significant drying has occurred, the coating on the surface of the rod 12 is more even.

Rapid drying is a very important consideration in most plants where space is limited. Rod speeds into the drawing machine 22 may be in the range of from about one foot per second to about ten feet per second, with a continuous rod speed of about five feet per second (three hundred feet per minute) being preferred. Therefore, by drying the rod 12 in less than about ten seconds, about fifty feet of the rod 12 has to be accommodated between the coating means 18 and the drawing machine 22.

The drawing machine 22 includes a lubricating system 52 and tungsten carbide dies 54. The lubricating system 52 is arranged to continuously apply lubricant onto the rod 12 under pressure. The dies 54 may be selected to form spring wire, tire bead, rope and plating quality wire, to name only a few examples. The finished, drawn wire is designated by reference numeral 56.

The system described above may be capable of processing over a ton of steel rod per hour. Yet the tank 48 may contain only a relatively small amount of the liquid 20 (for example, two hundred gallons or less). Therefore, the concentration of contaminants such as iron oxide, steel particles and rust builds up rapidly in the tank. The concentration of contaminants in the tank can easily build up to more than one-half of one percent of the total weight of the liquid stored in the tank. This contamination makes it difficult to dry the liquid because the iron hydroxides are hydrophillic. Moreover, the contaminants leave a residue on the drawn steel wire which reduces the wire's resistance to electrolytic corrosion.

Thus, in one preferred embodiment of the present invention, the contaminants within the coating liquid 20 stored within the tank 48 are removed by filtration or magnetic separation. The contaminants are preferably removed continuously. With the resulting clean liquid, the rod 12 is coated more uniformly, is more easily dried, and has an increased shelf life after being drawn to its finished size.

The above description and drawings are only illustrative of preferred embodiments which achieve the objects, features and advantages of the present invention, and it is not intended that the present invention be limited thereto. Any modification of the preferred embodiments coming within the spirit and scope of the following claims is to be considered part of the present invention.

What is claimed as new and desired to be protected by Letters Patent of the United States is:

1. A method of treating a continuous steel rod, said method comprising the steps of:

providing a tank containing a liquid borax solution;

continuously moving said steel rod relative to said tank;

during said step of continuously moving said rod relative to said tank, continuously applying said liquid borax solution to said continuous rod, and thereby forming a liquid film on said continuous rod; and during said step of continuously moving said rod relative to said tank and prior to said step of applying said liquid borax solution to said rod, preheating said rod such that said liquid film is dried by residual heat from said rod, such that a dried coating is formed on said continuous rod from said liquid film, said coating facilitating size reduction of said rod by drawing; and during said step of applying said liquid borax solution to said continuous rod, substantially continuously removing iron oxide and steel particles from said tank, and thereby conditioning said liquid borax solution; and wherein said continuous rod is not handled, subsequent to the application of said liquid borax solution, until substantial drying of said liquid film occurs, to maintain the uniformity of said dried coating.

2. The method of claim 1, further comprising the step of mechanically descaling said rod.

3. The method of claim 2, wherein said preheating step includes heating said rod to a temperature in the range of from eighty degrees centigrade to one hundred eighty degrees centigrade.

4. The method of claim 3, wherein said preheating step includes heating said rod to a temperature within a range of from eighty degrees centigrade to one hundred eighty degrees centigrade, wherein said liquid includes about five percent to about forty percent by weight $Na_2B_4O_7 \cdot 5H_2O$, and wherein said liquid film dries onto said rod to less than about thirty percent water in about ten seconds without any wiping or additional heating, and wherein said dried coating has a substantially uniform dried coating weight of over four hundred milligrams per foot.

5. The method of claim 4, further comprising the step of reducing the size of the rod by drawing, said step of reducing the size of said rod occurring subsequent to said step of forming said dried coating.

6. The method of claim 5, wherein the rod is continuously moved relative to said tank at a speed of from about one foot per second to about ten feet per second.

7. The method of claim 6, wherein the rod is continuously moved relative to said tank at approximately five feet per second.

8. The method of claim 6, wherein said descaling step includes the step of using a plurality of sheaves to bend the rod, said sheaves being located within different planes.

9. The method of claim 6, wherein said drawing step is performed by one or more dies, and said method further comprises the step of applying lubricant to the rod.

10. The method of claim 6, wherein said preheating step includes the steps of using a rotatable drum to repeatedly transport the rod through a space, and blowing hot air onto the rod as the rod is transported through said space.

11. The method of claim 6, wherein the liquid borax solution is supplied from said tank to coating applicators, and wherein said liquid borax solution is applied to said rod by said coating applicators, and wherein excess liquid borax solution drips back into said tank from said coating applicators by gravity.

12. The method of claim 11, wherein said iron oxide and steel particles are continuously removed from said tank by filtration.

13. The method of claim 11, wherein said iron oxide and steel particles are continuously removed from said tank by magnetic separation.

* * * * *